United States Patent [19]

Lanigan, Jr. et al.

[11] Patent Number: 4,749,328

[45] Date of Patent: Jun. 7, 1988

[54] AUXILIARY HOIST GRAPPLE

[75] Inventors: John J. Lanigan, Jr., Lynwood; Myron Glickman, Morton Grove; Bernard A. Ermel, Clarendon Hills, all of Ill.

[73] Assignee: Mi-Jack Products, Inc., Hazel Crest, Ill.

[21] Appl. No.: 920,787

[22] Filed: Oct. 20, 1986

[51] Int. Cl.[4] ..... B66C 3/16

[52] U.S. Cl. ..... 414/459; 414/460; 414/626; 212/220

[58] Field of Search ..... 414/458, 459, 460, 607, 414/626, 461, 786; 212/199, 218, 220, 221

[56] References Cited

U.S. PATENT DOCUMENTS

| | | | |
|---|---|---|---|
| 3,110,404 | 11/1963 | De Stasi | 414/460 X |
| 3,161,309 | 12/1964 | Baudhuin et al. | 414/459 |
| 3,251,496 | 5/1966 | Lamer et al. | 414/459 |
| 4,079,844 | 3/1978 | Whitaker et al. | 414/626 X |
| 4,279,347 | 7/1981 | Appleman | 212/220 X |
| 4,286,722 | 9/1981 | Tax et al. | 414/626 X |
| 4,358,020 | 11/1982 | Thiele | 414/460 X |
| 4,546,891 | 10/1985 | Lanigan, Sr. et al. | 414/460 X |

*Primary Examiner*—Robert J. Spar

*Assistant Examiner*—Vien Nguyen

*Attorney, Agent, or Firm*—Robert A. Brown

[57] ABSTRACT

A crane and lift apparatus for controlling the operation of primary hoist and bridge structure, and gantry drive functions of the equipment. There is provided an auxiliary hoist grapple apparatus to unload containers stacked one above another from one location to another parallel thereto, from one roadway to a parallel roadway, or from one flat bed railroad car to another flat bed railroad car disposed upon a track that is parallel to and adjacent to the track on which the first railroad car is located. The apparatus is adaptable to straddle two locations, parallel roadways, or parallel railroad tracks and effect interchange of containers to and from trucks or railroad cars positioned on the parallel roadways or tracks. The apparatus permits locking of the main stabilizing beam at an uppermost position to clear double stacked containers and provides secondary vertical motion so as to reach down adjacent the stacked container and pick up a container from a lower most position resting on the ground or from a truck or a flat bed railroad car. The apparatus permits selective raising and lowering of cable supported containers up to as much as thirty feet from ground level.

6 Claims, 6 Drawing Sheets

AUXILIARY HOIST GRAPPLE

BACKGROUND OF THE INVENTION

The present invention relates generally to the handling of transport containers and, more particularly, is concerned with an apparatus and method for lifting and transporting a plurality of large containers through the use of an auxiliary hoist grapple.

DESCRIPTION OF THE PRIOR ART

In recent years, the use of large transport containers of several standardized forms has gained widespread use in industry. These containers permit the efficient transfer of cargo from ships to transporting vehicles, between different transporting vehicles, and to and from storage facilities. Because of the large size of the cargo containers, it has been necessary to develop equipment having the capability of effectively handling the heavy loads required for their lifting and transport. One common apparatus for lifting and transporting containers from place to place is in the form of large, self-powered gantry cranes having several separate powered functions. The crane must deliver power to drive wheels, steering mechanisms and brakes. The equipment must also be capable of moving interconnected stabilizing or bridge beams for positioning over the loads to be carried and of operating a hoist mechanism to raise and lower the containers.

In the transportation industry, specific types of transport containers have been developed for use as trailers adaptable to be connected to a truck tractor, self-contained units for loading aboard ship, or to be secured upon flat-bed railroad cars. In order to improve the efficiency of moving containers from one place to another, such as from a roadway to a railroad or a ship's hold, or any combination from or to such positions of repose, crane apparatus have been developed to straddle at least two parallel roads, tracks and the like. In addition, within the past few years, the practice of double stacking of containers has become more popular requiring from twenty-five to thirty feet of clearance between a roadway or railhead and the bottom side of a hoisting apparatus.

Accordingly, the long lengths of cable that are reeled off or returned to the hoist drum disposed on the bridge beams are subject to swaying, swinging and the like when connected to a container or trailer holding from thirty to forty tons of dead weight materials. Further, when a container is lifted from the ground on one road or track and moves vertically in close proximity to two or more stacked containers on an adjacent road or track, the lifted container is likely to swing into the stacked containers and cause considerable damage. Thus, there is a need to provide apparatus that can prevent swaying or swinging of containers, throughout the entire vertical distance the containers are raised or lowered, when moved from ground level to the top of several stacked containers or at any level therebetween.

SUMMARY OF THE INVENTION

Therefore, it is a primary object of the present invention to provide a lifting apparatus that is stable during vertical movement between ground level and the upper most horizontal beam structure of a crane.

It is a further object of the present invention to provide a lifting apparatus that includes first controlled primary vertical movement and a separately controlled secondary vertical movement of containers.

An additional object of the present invention is to provide a lifting apparatus capable of raising and lowering containers from ground level in substantially rectilinear vertical movement.

It is still a further object of the present invention to provide a lifting apparatus having a stabilizing beam assembly for movement in a first vertical direction, a first frame assembly for movement in a horizontal direction, and a second frame assembly for movement in a supplemental vertical direction.

Another object of the present invention is to provide a lifting apparatus having an upper frame assembly movable in a first incremental vertical direction and a lower frame assembly and grappler arms adaptable to raise or lower trailers or containers in substantially vertical rectilinear alignment.

These and other objects are achieved in accordance with the present invention wherein there is provided an improved crane and lift apparatus having auxiliary hoist grapple means adapted to connect with and control vertical movement of containers so that optimum efficiency is achieved in moving containers from one location to another location at a different vertical level. The auxiliary hoist grapple apparatus includes an upper frame assembly adaptable to move horizontally over a plurality of stacks of containers and also be raised or lowered in a first incremental vertical direction, a lower frame assembly depending from and movable vertically to and from the upper frame assembly, a grapple arm assembly at times disposed upon the lower frame assembly for securing therein a trailer or container, and power drive means for selectively moving the upper frame assembly in a horizontal direction in a first incremental vertical movement, and for moving the lower frame assembly vertically to selective levels between ground level and the upper frame assembly, whereby the trailers or containers are selectively moved from one location to another.

BRIEF DESCRIPTION OF THE DRAWINGS

The foregoing and other characteristics, objects, features and advantages of the present invention will become more apparent upon consideration of the following detailed description, having reference to the accompanying figures of the drawings, wherein.

DESCRIPTION OF A PREFERRED EMBODIMENT

Figure 1:
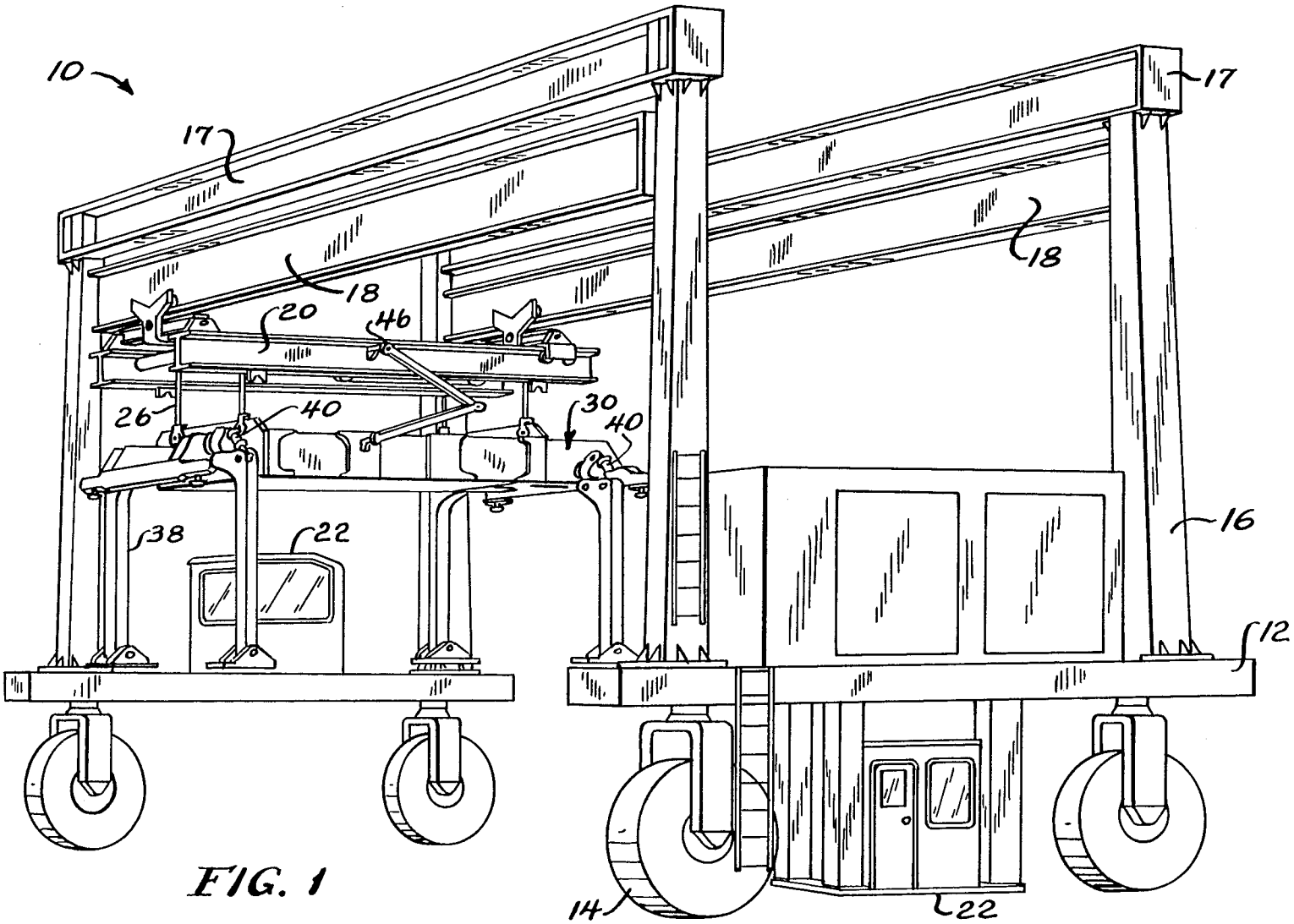
FIG. 1 is a perspective view of a crane apparatus including the auxiliary hoist grapple of the invention.

Referring now to FIG. 1 there is shown a crane and lifting apparatus, generally indicated by reference numeral 10, capable of movement along ground level and of lifting and transporting one or more of a stack of trailers or large containers used in roadway, shipping or railroad transportation applications. The apparatus 10 includes a typical overhead bridge-like construction having a number of known features. The lower portion of the crane includes a pair of lower beams 12 supported by four pivotally attached wheel assemblies 14, selectively powered by drive means for moving the crane along ground level. Two upright corner beams 16 are disposed at outer ends of each lower beam 12 and in turn support at their upper ends the respective outboard ends of two bridge beams 17. The assembly thus described is effective to move along and span a transportation container workplace, a plurality of roadways or railroad tracks, and the like.

Directly underneath each of the bridge means 17 is a stabilizing beam 18 having its respective outer ends secured in suitable track or other slidable means on the upright corner beams 16. The stabilizing beams are powered by suitable drive means controlled by an operator and are adaptable for vertical movement as a unit up and down the corner beams 16.

Figure 2:
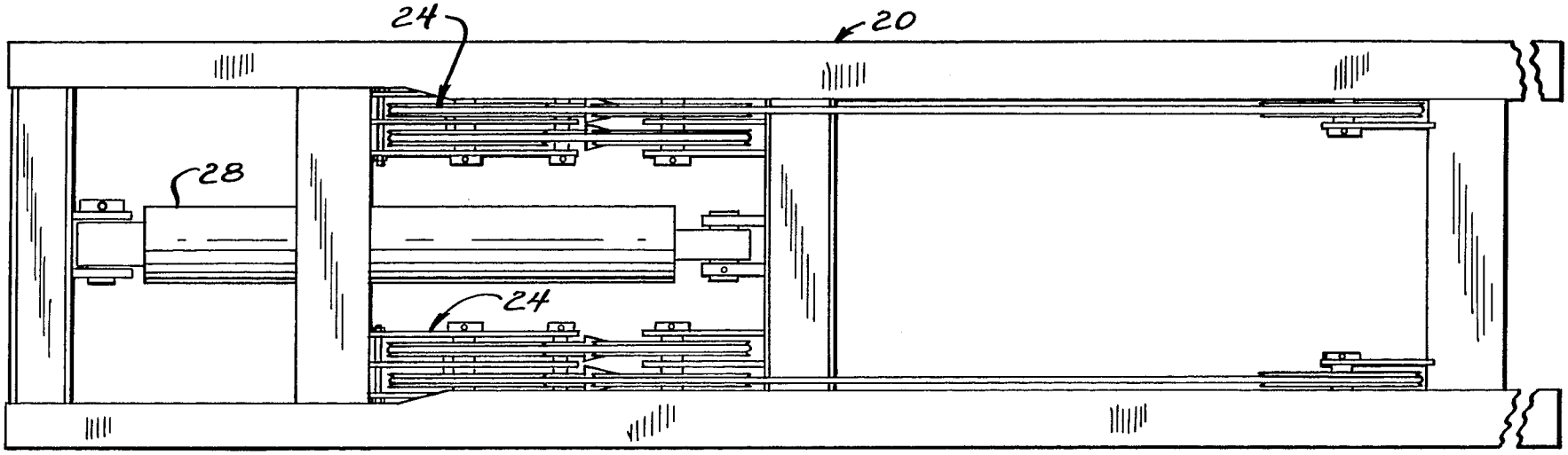
FIG. 2 is a plan view of the upper frame assembly of the auxiliary hoist grapple shown in FIG. 1.
Figure 3:
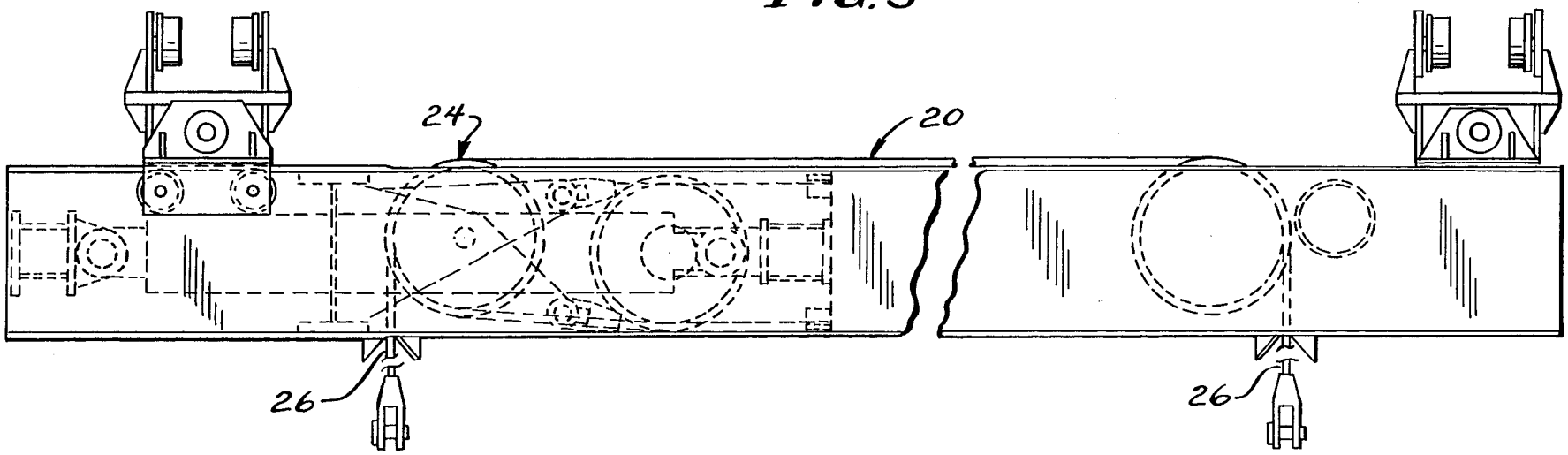
FIG. 3 is a side elevational view of the upper frame assembly of the auxiliary hoist grapple shown in FIG. 1.

An upper frame assembly 20 (FIGS. 2 and 3) is mounted for transverse movement at its outer ends along the underside of the stabilizing beams 18. The upper frame assembly 20 is powered by suitable drive means controlled by an operator from either of an operator's cab 22 disposed on opposite sides of the crane. Movement of the crane along ground level is, of course, also controlled by the operator from one or the other of the operator's cabs 22. The upper frame assembly 20 includes hoist drum means 24 having several pulleys and sheaves that are adaptable to pay out and reel in four corner cables 26 disposed generally at the four corners of the upper frame assembly 20. An auxiliary hoist cylinder 28 is provided for operation of the hoist drum for paying out or reeling in the corner cables 26 and is controlled by suitable means from one or the other of the operator's cabs 22.

Figure 4:
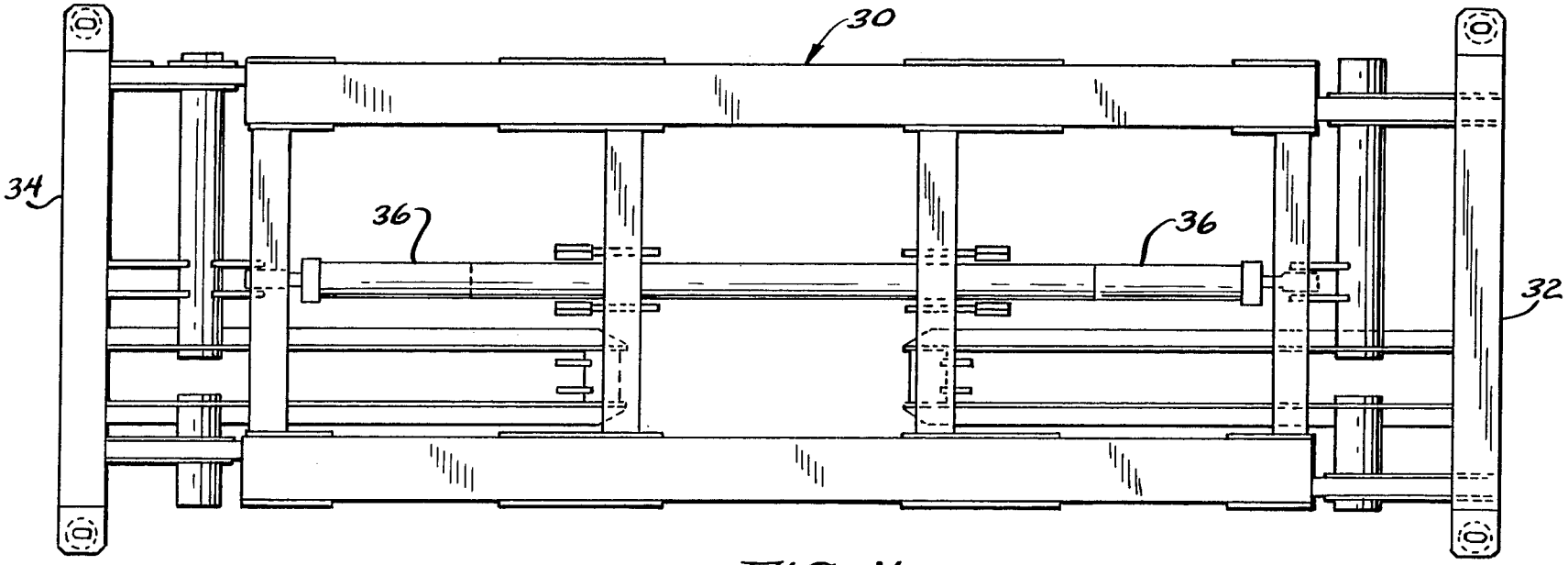
FIG. 4 is a plan view of the lower frame assembly of the auxiliary hoist grapple shown in FIG. 1.

Depending from and supported by the four corner cables is a lower frame assembly 30 (FIGS. 4 and 5) adaptable for vertical movement between ground level and the underside of the stabilizing beams 18. Interconnected between upper frame assembly 20 and lower frame assembly 30 is an articulated stabilizing means 46 that provides static structural rigidity between the upper and lower frame assemblies when disposed away from each other by the operation of corner cables 26. Disposed at one end of the lower frame assembly 30 is a front sliding box 32 adaptable for operation in a manner hereinafter described in more detail. Similarly, there is disposed at the other end of the frame assembly 30, a rear sliding box 34. An extension cylinder 32 is disposed within the lower frame assembly 30 for inward and outward movement of the front and rear sliding boxes 34 and 32 and is controlled by the operator from one or the other of the operator's cabs 22. It will be understood that upper extension cylinder 36 having one end restrained against movement within the structure of lower frame assembly 30 and its other end connected to front sliding box 32, may be extended or retracted to move the sliding box 32 for positioning over and about one end of a container for attachment thereto. Similarly, the lower extension cylinder 36 having one end restrained against movement within the structure of lower frame assembly 30 and its other end connected to rear sliding box 34, may be extended or retracted to move the sliding box 34 for positioning over and about the other end of the container for attachment thereto. This arrangement permits slight incremental adjustments in securing the frame assembly to a container without having to move the entire apparatus longitudinally along the length of the container.

Figure 6:
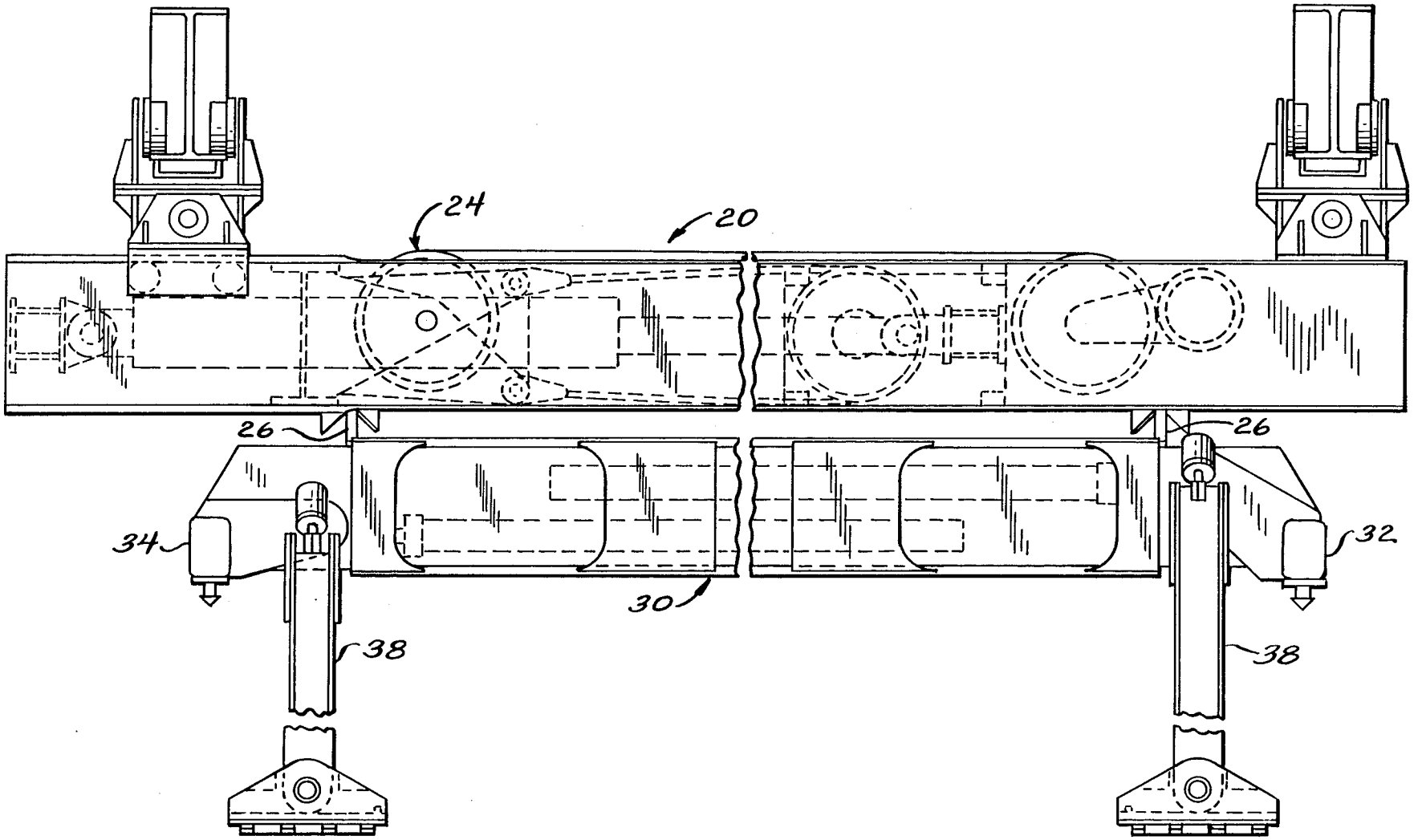
FIG. 6 is a side elevational view of the auxiliary hoist grapple of the invention showing the upper and lower frame assemblies in association with the grappler arms.
Figure 7:
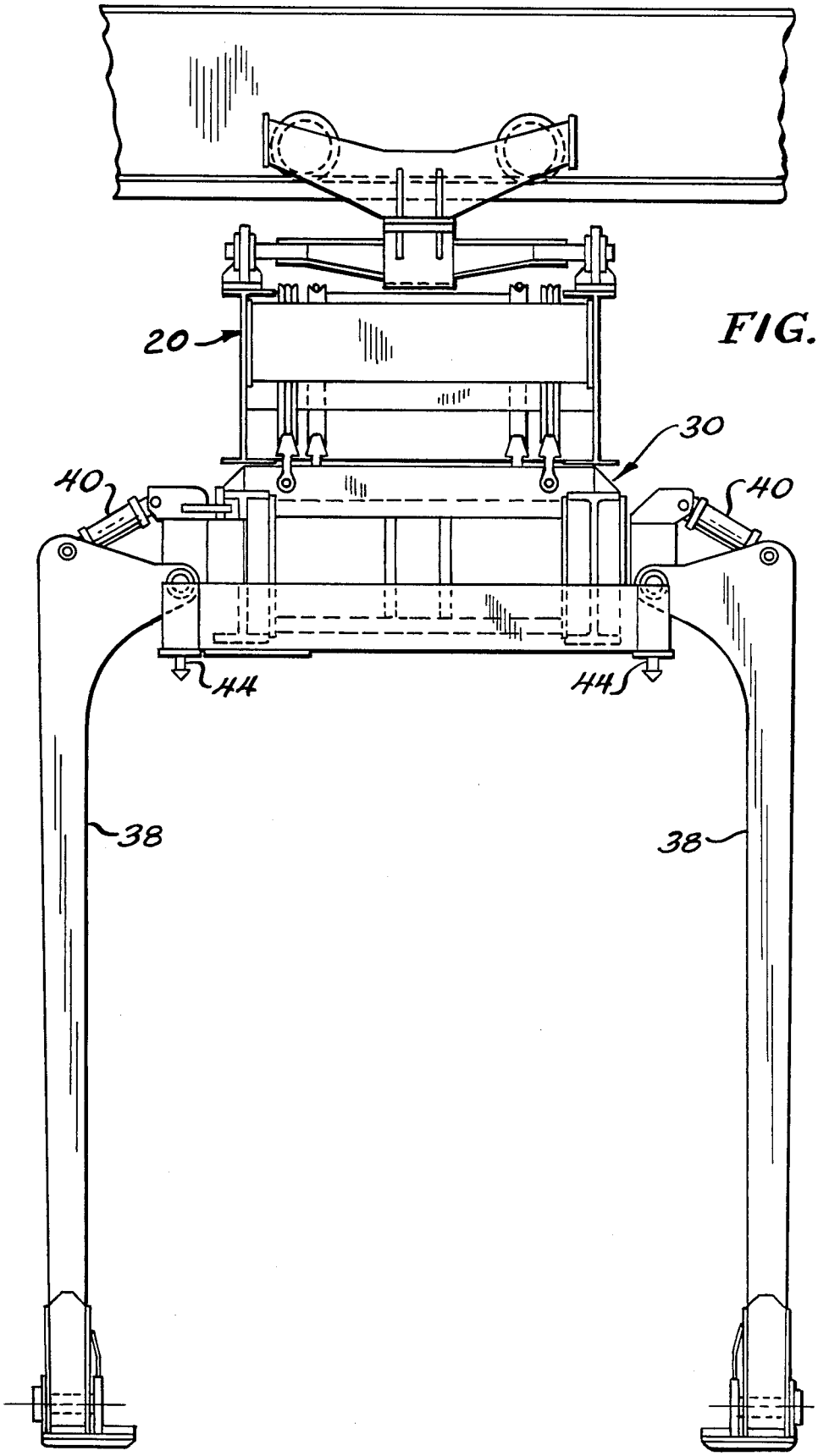
FIG. 7 is an end side elevational view of the auxiliary hoist grapple of the invention showing the upper and lower frame assemblies in association with the grapple arms.

Disposed at four corners of the lower frame assembly 30 are four pivotally supported grappler arms 38, best seen in FIGS. 6 and 7, adaptable to be enveloped over and about a trailer for secure attachment therein. The grappler arms 38 are caused to operate by grappler arm cylinders 40 and are controlled by the operator from one or the other of the operator's cabs 22.

Figure 8:
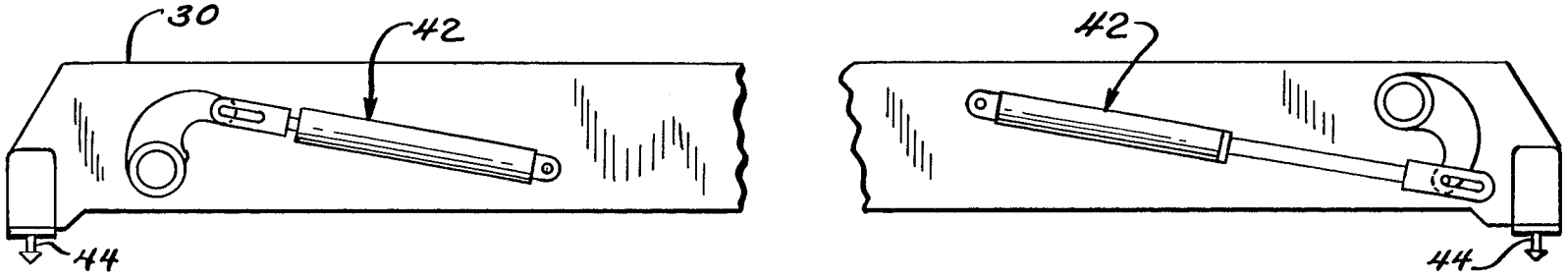
FIG. 8 is a side elevational view taken along lines A—A of FIG. 7 showing a portion of the lower frame assembly operating mechanism for rotating the grapple arms upwardly to a stowed position so that the lower frame assembly may be attached to the top side of a container.

As shown in FIG. 8, a cylinder and arm assembly 42 is operable to rotate the grappler arms 38 approximately ninety degrees from a downwardly depending position to a stowed position along the outer sides of the lower frame assembly in a substantially horizontal orientation.

Figure 5:
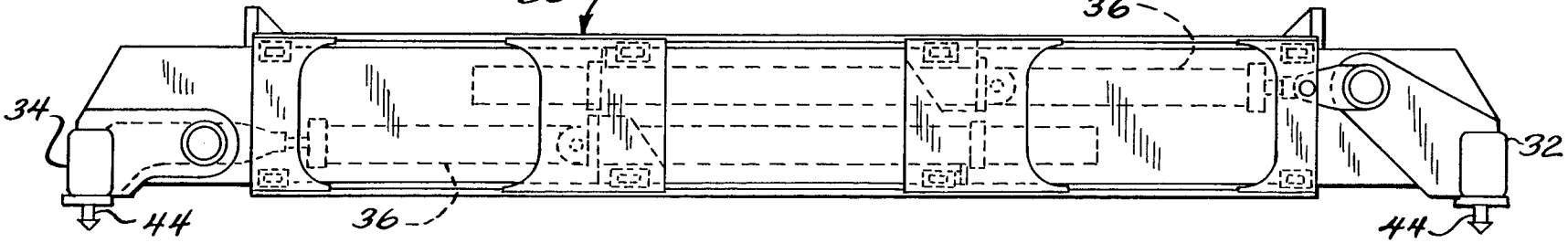
FIG. 5 is a side elevational view of the lower frame assembly of the auxiliary hoist grapple shown in FIG. 1.

Referring to FIG. 5, there are disposed at four corners of the lower frame assembly suitable attachment means 44 for connecting with and supporting securely a container at its four corners.

In operation of the crane and lifting apparatus of the invention, the structure may be moved along ground level to be positioned over a plurality of roads or tracks on which are located one or more containers disposed singly or in stacks adjacent to each other. If the containers are stacked to a high level, the lower frame assembly 30 is moved to an upper most position just underneath the upper frame assembly 20. The attachment means 44 are then secured to the container to be transported and the container is then lifted off the stack. The upper frame assembly is then suitably moved transversely, if it is desired to move the container to an adjacent parallel location. If the movement of the container is to be toward another location that is tandemly oriented, the crane is moved along ground level. It can be seen that the crane and lifting apparatus is adaptable to transport the container in any one of three directions; namely, longitudinal, transversal, or in primary or secondary vertical incremental movement.

When it is desired to pick up a container that is on ground level next to a stack of several containers piled on top of each other, the upper frame assembly 20 is moved to a location substantially overhead the ground level container. The stabilizing beams 18 and the upper frame assembly are then lowered to an elevation just above the level of the highest of the stacked containers so that no interference or crushing of containers occurs. The lower frame assembly 30 is then suitably lowered to close proximity of the container, the attachment means are affixed thereto, and the container is then raised to any desired level for transporting to an alternate location. In this manner, it can be readily understood that close control of vertical movement of a container is achieved that avoids swaying and swinging of cables depending from a bridge member suspended at heights of up to thirty feet. The lower frame assembly 30 being connected directly to the container provides a stable and easily controlled secondary platform means when moved vertically, either upwardly or downwardly.

It will be noted that when the vertically moving stabilizing beams and upper frame assembly approach the top side of a stack of containers, there is provided automatic stop means for stopping the downward travel of the stabilizing beams. An electrical signal is then transferred from the stabilizing beams main hoist to auxiliary hoist means so that the lower frame assembly can be moved independently downwardly for attachment to a lowermost or ground level container.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A crane and lift apparatus including frame means having a pair of lower beams supporting four corner beams in turn supporting a pair of vertically movable upper stabilizing beams forming generally parallel track means transverse to said lower beams, wheel means rotatably supported beneath said frame means, drive means operatively coupled to said wheel means for causing movement of said frame means, auxiliary hoist means mounted underside and between said stabilizing beams for rectilinear movement therealong, said auxiliary hoist means comprising upper frame assembly means movably mounted on said stabilizing beams and having rotatably mounted hoist drum means, cable means operatively attached to said hoist drum means and suspended downwardly therefrom, lower frame assembly means attached to a lower most portion of said cable means adaptable for vertical movement relative to said upper frame assembly means, and grapple arm assembly means depending from said lower frame assembly means for attaching to, carrying and releasing one or more containers, power drive means operatively coupled to said drive means, said upper frame assembly and said hoist drum means, said power drive means acting selectively to operate said drive means to cause movement of said frame means, to move said upper frame assembly along said upper stabilizing beams, and to rotate said drum hoist means for lifting and lowering said containers, and operator control means connected to said power drive means for independently controlling the operations of said drive means, said upper frame assembly and said drum hoist means.

2. The crane and lift apparatus of claim 1 wherein said upper frame assembly means is movable horizontally at an uppermost level of the apparatus, and said lower frame assembly means is movable in a substantial vertical direction between ground level and said uppermost level of the apparatus.

3. The crane and lift apparatus of claim 1 comprising articulated stabilizing means connected between said upper and said lower frame assemblies.

4. The crane and lift apparatus of claim 1 wherein said upper frame assembly is effective to provide primary controlled incremental adjustment of vertical movement of said containers, and said lower frame assembly is effective to provide secondary controlled incremental vertical movement of said containers.

5. The crane and lift apparatus of claim 1 wherein said lower frame assembly and an attachment means are effective to provide a secondary stable platform for controlled vertical movement of said containers.

6. A method of controlling vertical movement of containers, raised and lowered by a crane and lift apparatus, comprising the steps of providing frame means having a pair of lower beams supporting four corner beams in turn supporting a pair of vertically movable upper stabilizing beams forming generally parallel track means transverse to said lower beams, providing wheel means rotatably supported beneath said frame means, drive means operatively coupled to said wheel means for causing movement of said frame means, providing an upper frame assembly supported by said stabilizing beams for horizontal movement at an uppermost level of the apparatus, providing a lower frame assembly having means for attachment to said containers depending from said upper frame assembly and operable to be raised or lowered vertically in relationship thereto, moving said upper frame assembly to a position substantially overhead at least one of said containers, lowering said upper frame assembly in a first incremental vertical direction to an elevation just above the top of a plurality of stacked containers, raising or lowering said lower frame assembly to a position substantially adjacent the upper side of said one of said containers, securing said attachment means to said one of said containers, and raising or lowering said one of said containers in a controlled secondary incremental vertical direction so as to remove said one of said containers from a first to an alternate location.

* * * * *